US011673714B2

(12) United States Patent
Zimmerman

(10) Patent No.: US 11,673,714 B2
(45) Date of Patent: Jun. 13, 2023

(54) CARD PACKAGING SYSTEM

(71) Applicant: The Imagine Group, LLC, Shakopee, MN (US)

(72) Inventor: Wayne E. Zimmerman, Newhall, CA (US)

(73) Assignee: The Imagine Group, LLC, Shakopee, MN (US)

( * ) Notice: Subject to any disclaimer, the term of this patent is extended or adjusted under 35 U.S.C. 154(b) by 0 days.

(21) Appl. No.: 17/012,033

(22) Filed: Sep. 3, 2020

(65) Prior Publication Data

US 2021/0061518 A1 Mar. 4, 2021

Related U.S. Application Data

(60) Provisional application No. 62/895,362, filed on Sep. 3, 2019.

(51) Int. Cl.

| | |
|---|---|
| ***B65D 25/22*** | (2006.01) |
| ***B65D 75/22*** | (2006.01) |
| ***B65D 25/04*** | (2006.01) |

(52) U.S. Cl.

CPC ..... *B65D 25/22* (2013.01); *B65D 25/04* (2013.01); *B65D 75/22* (2013.01); *B65D 2575/565* (2013.01)

(58) Field of Classification Search

CPC ..... A45C 2011/186; B65D 2201/00; B65D 25/22; B65D 5/4237; B65D 5/73; Y10S 206/806

(Continued)

(56) References Cited

U.S. PATENT DOCUMENTS 4,739,883 A * 4/1988 Mohs ..... B65D 73/00 206/461
6,244,444 B1 * 6/2001 Jacobus ..... B65D 25/205 206/703

(Continued)

FOREIGN PATENT DOCUMENTS

WO WO 2005/114543 A2 12/2005
WO WO 2018/162799 A1 9/2018

OTHER PUBLICATIONS

International Search Report for corresponding International Application No. PCT/US2020/049292, dated Dec. 15, 2020, 3 pages.

(Continued)

*Primary Examiner* — Mollie Impink
(74) *Attorney, Agent, or Firm* — Winthrop & Weinstine, P.A.; Alicia Griffin Mills; Nadeem W. Schwen

(57) ABSTRACT

A novel and advantageous packaging system for card packaging system is provided. The card packaging system can hold a card and a promotional item and can display the serial number of the card while keeping the personal identification number for the card hidden. The card packaging system can be easily hung from a merchandise display. The card packaging system may include a card unit comprising a card, a hanger, and a stem, the stem being positioned between the card and the hanger, wherein the card may be separate from the hanger and the stem. The card packaging system may further comprise a case for receiving the card unit, the case including a slot for receiving the stem such that the card is positioned in the case and the hanger extends outwardly from the case.

17 Claims, 7 Drawing Sheets

(58) Field of Classification Search
USPC ..... 206/469, 470, 471
See application file for complete search history.

(56) References Cited

U.S. PATENT DOCUMENTS

| | | | | |
|---|---|---|---|---|
| 7,163,152 | B2 * | 1/2007 | Osborn | A45C 11/182 235/487 |
| 7,404,487 | B2 * | 7/2008 | Kumakura | B65D 71/08 206/467 |
| 7,607,575 | B2 * | 10/2009 | Kingsborough | B42D 25/00 235/375 |
| 7,883,004 | B2 * | 2/2011 | Halbur | G06Q 40/00 235/379 |
| 9,415,916 | B2 * | 8/2016 | Hahn | B65D 81/127 |
| 2005/0247798 | A1 | 11/2005 | Graves et al. | |
| 2007/0266605 | A1 * | 11/2007 | Halbur | G09F 1/00 40/674 |
| 2009/0140042 | A1 * | 6/2009 | Clegg | A45C 15/00 40/442 |
| 2010/0079284 | A1 | 4/2010 | Perez et al. | |
| 2012/0256006 | A1 | 10/2012 | Schmitt | |

OTHER PUBLICATIONS

Written Opinion for corresponding International Application No. PCT/US2020/049292, dated Dec. 15, 2020, 7 pages.

* cited by examiner

CARD PACKAGING SYSTEM

CROSS REFERENCE TO RELATED APPLICATION

This application claims the benefit of U.S. Provisional Application No. 62/895,362, filed on 3 Sep. 2019, the contents of which are incorporated herein by reference. A claim of priority, to the extent appropriate, is made.

FIELD OF THE INVENTION

The present disclosure relates to a novel and advantageous packaging system for packaging a card and an item in a manner to be hung from a display. Particularly, the present disclosure relates to a novel and advantageous system for packaging and hanging gift cards, gaming cards, and the like with a promotional item. The card packaging system can hold a card and a promotional item and can display the serial number of the card while keeping the personal identification number for the card hidden. The card packaging system can be easily hung from a merchandise display.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

There are many types of cards that are hung on a merchandising display for purchase. When it is desired to provide another item with the card, a retail packaging unit is used to package the card with the item. This may be useful when providing a promotional item with purchase of the card or when providing a card with purchase of an item. It is convenient to be able to use the same merchandising display to sell the card and promotional item combination as is used to sell the card by itself.

Current retail packaging units for a card and item combination include a case for housing the item and card, and a hanger component affixed or integral with the case, the hangar component being used to hang the package on a retail merchandise display. The case is commonly a gift box, clamshell case such as an Amaray case, or a gift tin. A window is provided in the case to allow visibility to the card.

To hang the case on a retail merchandising display, it is necessary to affix a hanger to the housing. Commonly, this is done by adhering a hanger to the back of the housing, that is, to the back of the clamshell, gift box, Amaray case, gift tin, etc. When this is done, the weight of the package is not even and the package tends to tip forward or backward while hanging.

Cards, such as gift cards, currency cards, and gaming cards have a unique serial number and a corresponding PIN number. These numbers are typically printed on a surface of the card. The serial number may be printed and viewable by any observer. The PIN number may be covered with an obscuring mechanism such as a scratch off. When the card is purchased at a retail location, the serial number of the card is scanned at the point of sale. Scanning of the serial number activates the PIN number such that the card can be used. When the owner of the card wishes to use the card, he/she removes the scratch off, or other obscuring mechanism, to reveal the PIN number. The number can then be used to allow download and/or use of digital currency or content.

When a card is put in a case, it can be challenging to make the serial number accessible at the point of sale to allow for scanning of the serial number. One manner of giving access to the serial number is to provide a window in the case with the card being positioned in the case such that the serial number is viewable through the window.

The retail packaging for a gift card and product combination is tracked by hand and eye at final stages of production before shipment to each store. All packaging units are preferably in sequential order for tracking purposes for security and theft purposes (usually per store, per location, etc.). The current model of adding a promotional item with a gift card includes having to identify the pertinent unique variable codes for each card to activate at the register by scanning through a window in package.

There is a need in the art for a packaging system that facilitates packaging of a card together with an item, displays the combination of the card and the item on existing merchandising displays, allows viewing of the serial number of the card, and is easy to track during production and distribution.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to a packaging system that facilitates packaging of a card with another item. For example, the packaging system may be used to package a promotional item with a video game card. The packaging system comprises a card unit having a card, a stem, and a hanging component. Serial number information may be printed on the hanging component. The packaging system may further comprise a case that can receive the card unit and an item.

The card unit may comprise a card and a hanger with a stem at or near the intersection of the card with the hanger. The card, stem, and hanger may be integral. In some embodiments, a divider may be provided to allow the card to be separated from the stem and hanger. For example, the divider may be a cut line or a perforation. In alternative embodiments, the divider may be provided at a different position on the card unit. Serial number information may be printed on the hangar.

The packaging system may further comprise a case for receiving the card unit. A slot may be provided for allowing the card to be housed, the stem to be received by the slot, and the hangar component to extend from the case. If the serial number information is printed on the hanger component of the card unit, the serial number information printed on the hanger is thus visible outside the case and there is no need for a window in the package to allow viewing of the card.

In one embodiment, the card packaging system comprises a card unit and a case for receiving the card unit. The card unit comprises a card, a hanger, and a stem, the stem being positioned between the card and the hanger, wherein the card may be separated from the hanger and the stem. The case includes a slot for receiving the stem such that the card is positioned in the case and the hanger extends outwardly from the case.

In another embodiment, the card packaging system includes a card unit and a case for receiving the card unit. The card unit comprises a card and a hanger. The case includes a slot through which the hanger extends such that the card is positioned in the case and the hanger extends outwardly from the case.

In yet a further embodiment, a card packaging system comprises a card unit and a case for receiving the card unit. The card unit includes a card, a hanger, and a stem. The hanger includes a hole for receiving an extension from a merchandising unit. The stem is positioned between the card and the hanger. The card may be separated from the hanger and the stem. The case includes a first section and a second section and a hinge coupling the first section to the second section. When the case is closed, a slot is provided between the first section and the second section for receiving the stem such that the card is positioned in the case and the hanger extends outwardly from the case.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure relates to a novel and advantageous packaging system. In particular, the present disclosure relates to a novel and advantageous packaging system comprising a card unit and a case. In some embodiments, the card unit may be used with existing cases.

The present disclosure, in one or more embodiments, relates to a packaging system that facilitates packaging of a card with another item. For example, the packaging system may be used to package a promotional item with a video game card, gift card, or similar. In some embodiments, the packaging system comprises a card unit having a card, a stem, and a hanging component. The hanging component may also be referred to as the hanger. Serial number information may be printed on the hanging component. The packaging system may further comprise a case that can receive the card unit and display the serial number information on the hanging component outside of the case.

Figure 1A:
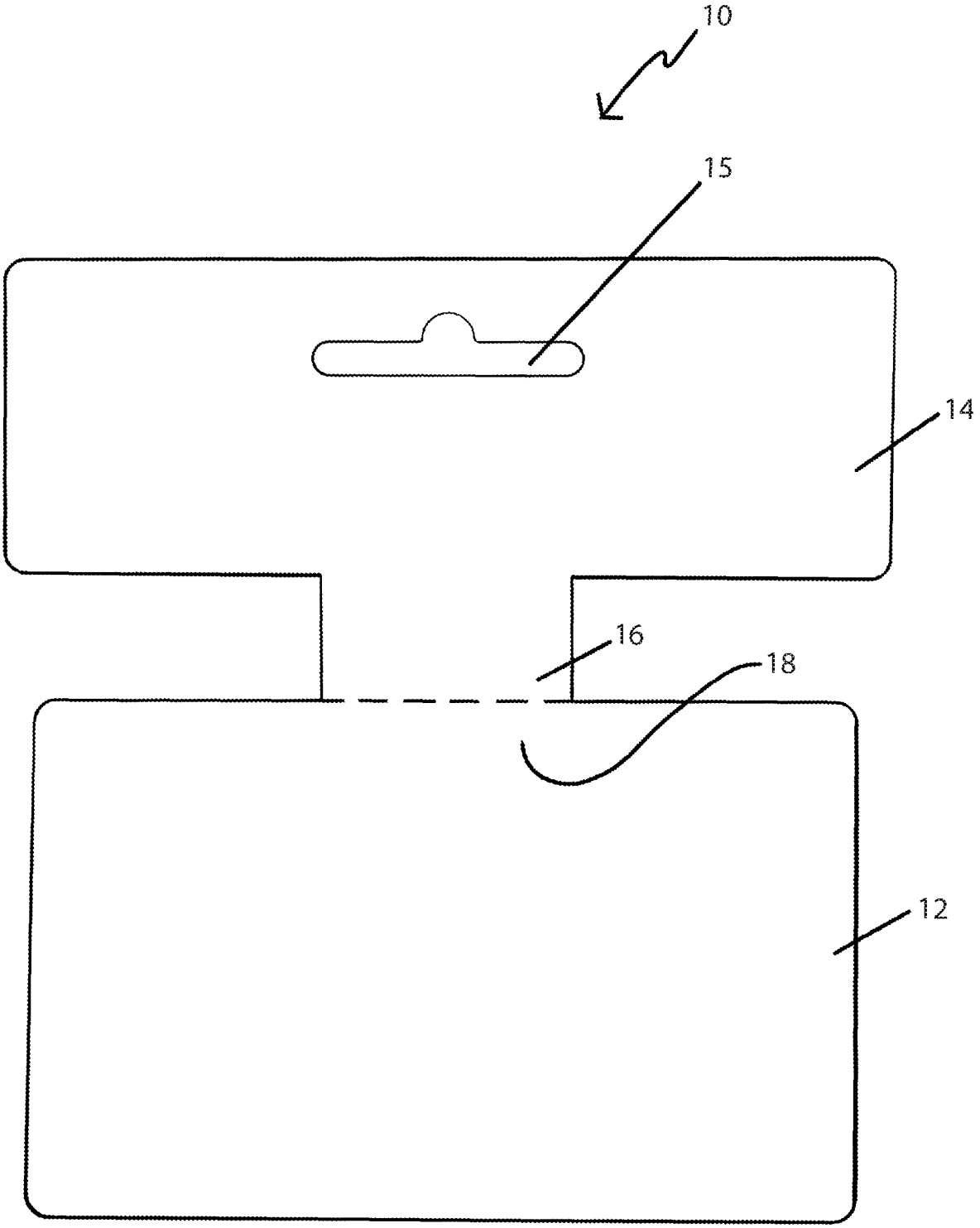
FIG. 1*a* illustrates a front surface of a card unit in accordance with one embodiment.
Figure 1B:
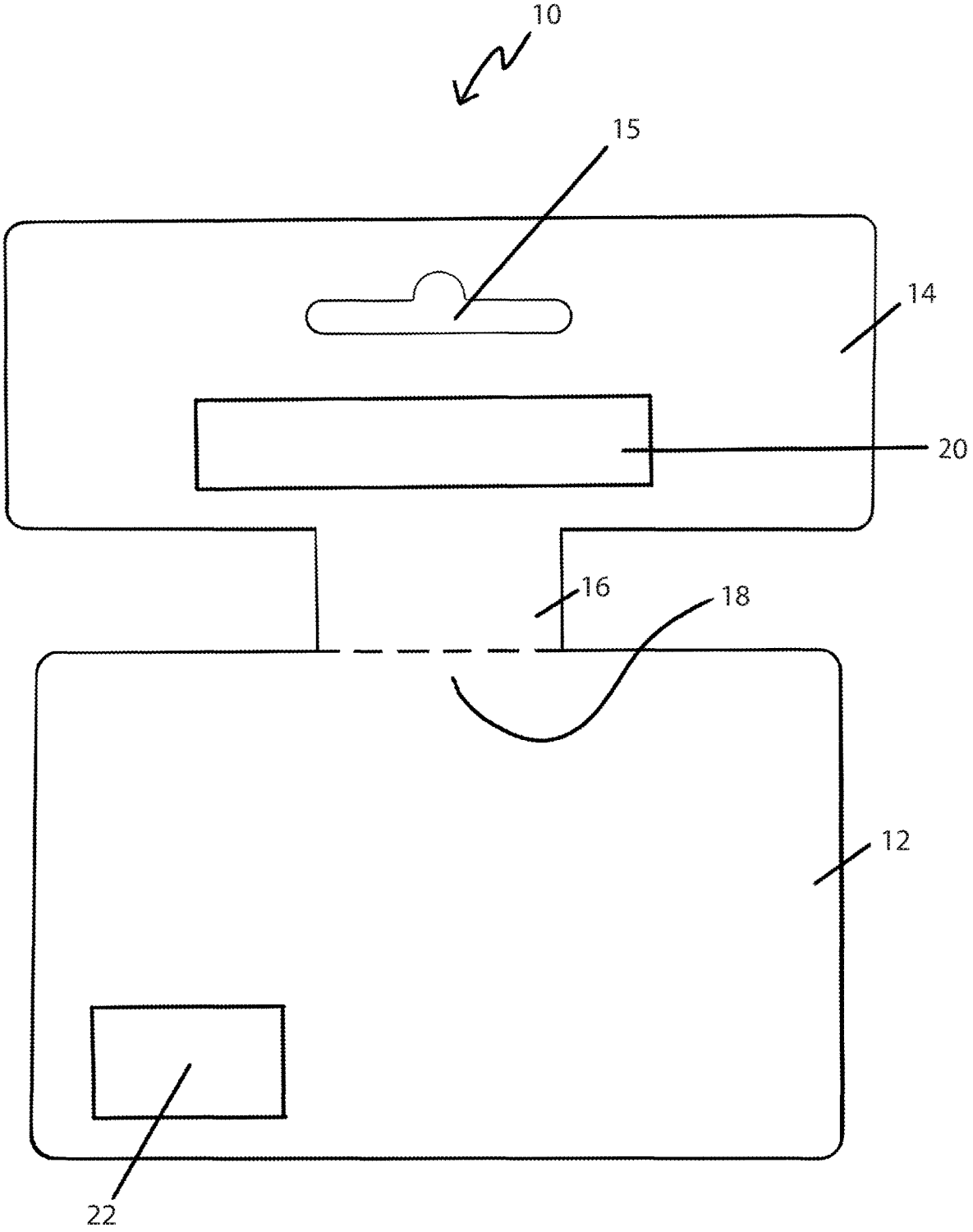
FIG. 1*b* illustrates a back surface of a card unit in accordance with one embodiment.

FIGS. 1*a* and 1*b* illustrate a card unit 10 in accordance with one embodiment. FIG. 1*a* illustrates a front surface of the card unit 10. FIG. 1*b* illustrates a back surface of the card unit 10. Front and back are generally arbitrary and may be swapped in various embodiments. The card unit 10 may comprise a card 12, a hanging component or hanger 14, and a stem 16. The hanger may include a hole 15 for receiving an extension from a merchandising unit such that the packaging system may be hung from the extension. The size and shape of the hole 15 may be customized for the merchandising unit. In the embodiment shown, the hole 15 is a sombrero. In other embodiments, an alternative mechanism, such as a hook extending from a top edge of the card, may be used for hanging the packaging system from an extension of a merchandising unit. The stem 16 may be positioned between the card 12 and the hanger 14. In general, the stem 16 functions to provide spacing from the card to the hanger such that the card can be received by a case. The stem 16 may be any suitable length or width and, in some embodiments, may be omitted. In some embodiments, the hanger 14 may perform the function of a stem 16. In such embodiments, a divider may be provided between the hanger 14 and the card for separating the hanger from the card 12.

The card 12, stem 16, and hanger 14 may be integral. In some embodiments, a divider 18 may be provided to allow the card 12 to be separated from the hanger 14 and stem 16, if provided. For example, the divider 18 may be a cut line, score, or perforation. Branding may be printed on the hanger, the stem, and/or the card. In some embodiments, a divider 18 may not be provided and the card 12 may be cut from the hanger 14 and stem 16, if provided, or may remain attached to the hanger 14 and stem 16.

The material used to form the card unit 10 may be selected based on characteristics useful in each embodiment. In some situations, it is useful to facilitate a clean breakaway of the card 12 from the stem 16 and hanger 14. This may be done by forming the card unit 10 out of styrene, for example, and providing the divider 18 as a cut line.

FIG. 1*b* illustrates a back surface of the card unit 10. As shown, a serial number or bar code 20 and personal identification number (PIN) 22 may be provided on the back surface of the card unit 10. In the embodiment shown, the serial number 20 is printed on the hanger 14 and the PIN 22 is printed on the card 12. An obscuring mechanism, such as a scratch off may be provided over the PIN 22. In alternative embodiments, the serial number 20 and the PIN 22 may be printed on alternative locations on the card unit 10. For example, one or both of the serial number 20 and the PIN 22 may be printed on the front (or back) surface of the card 12, the serial number 20 and the PIN 22 may both be printed on the hanger 14, etc. In addition, in some embodiments, the serial number 20 and/or PIN 22 may be printed on both the hanger 14 and the card 12.

Terms and conditions are commonly printed on gift cards. The card unit 10 has surface area on the hanger 14, the stem 16, and the card 10. Any of these surfaces may be used for displaying the applicable terms and conditions.

Figure 2:
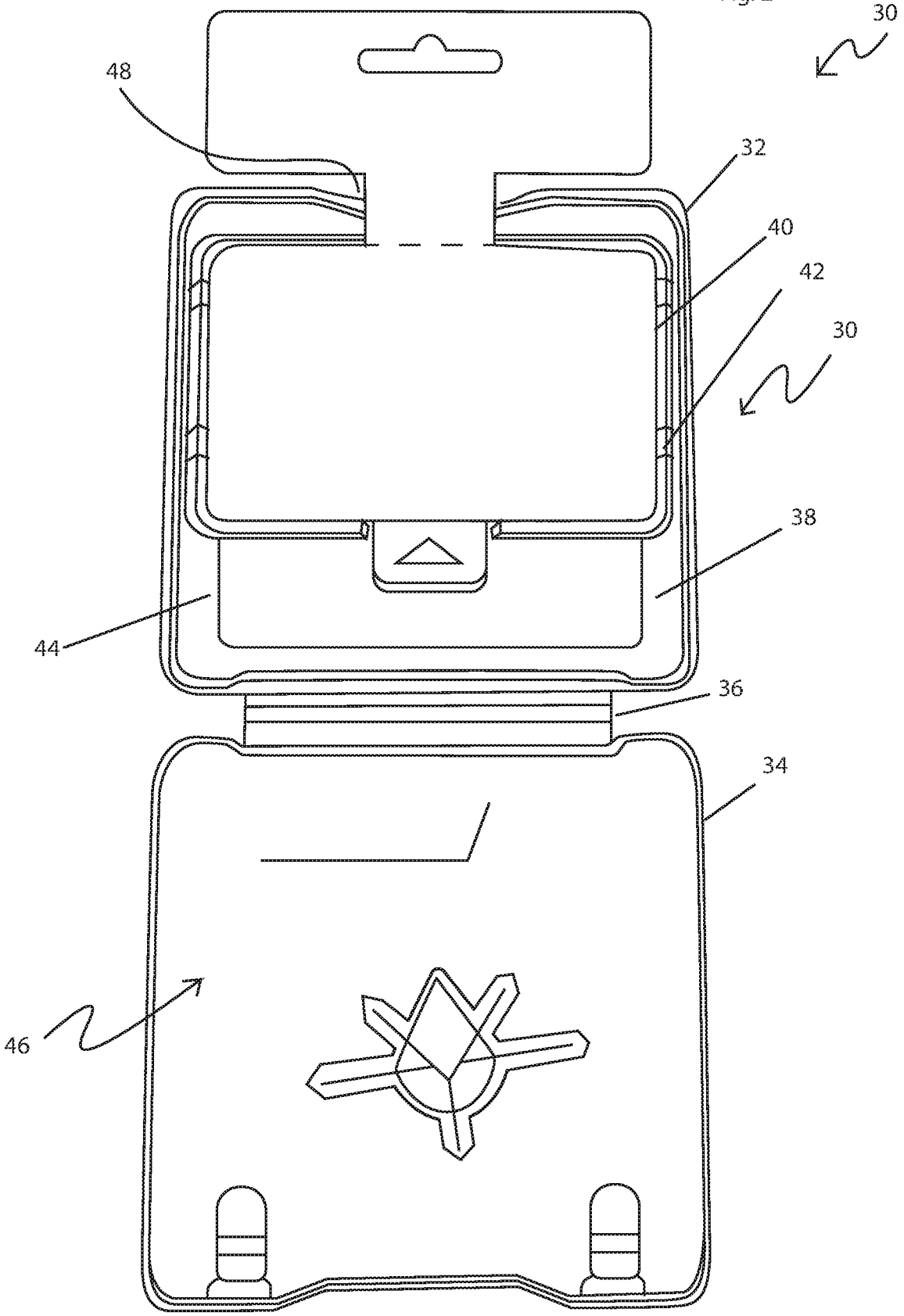
FIG. 2 illustrates an open case in accordance with one embodiment.
Figure 3:
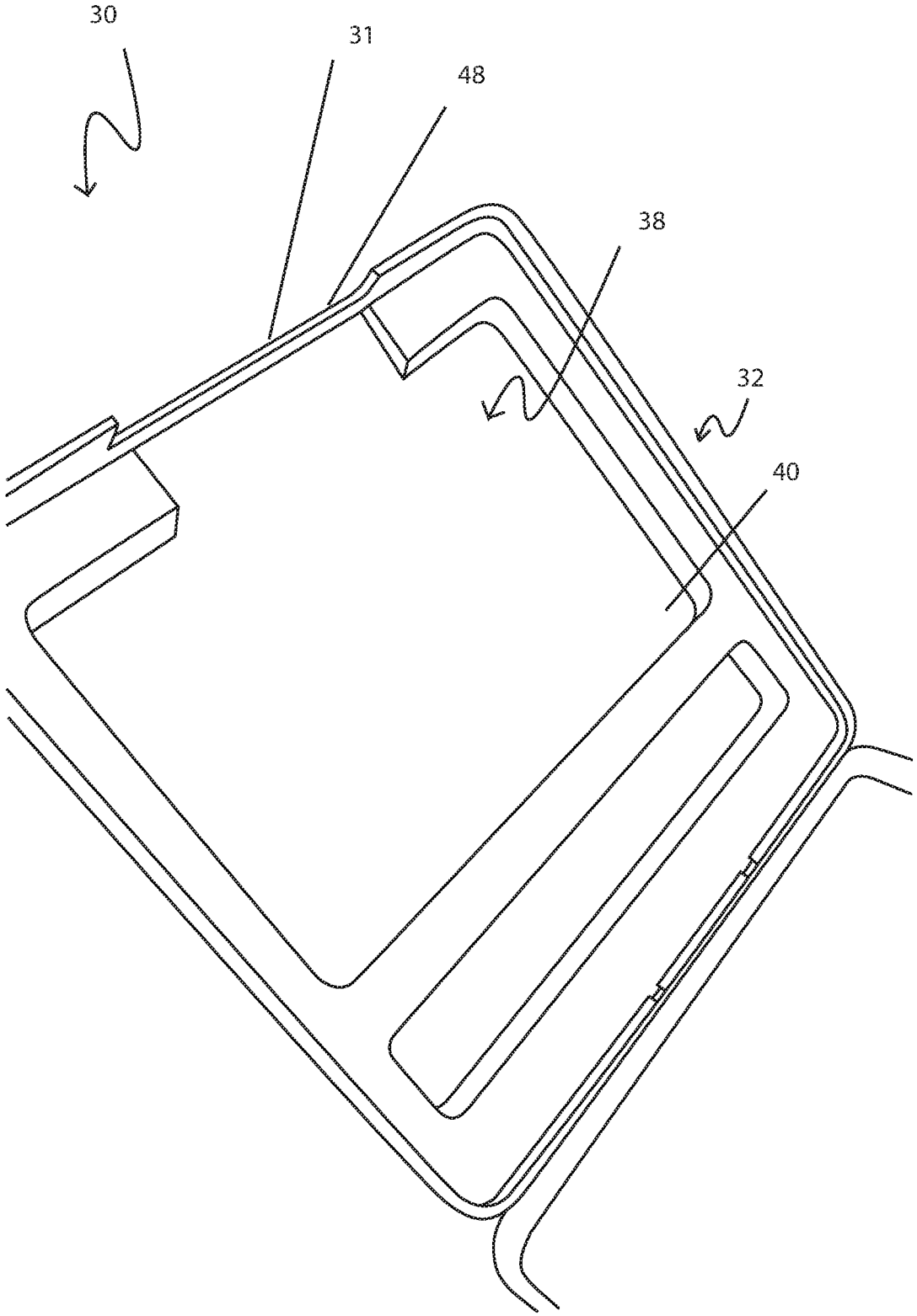
FIG. 3 illustrates an alternative embodiment of a case and insert.
Figure 4:
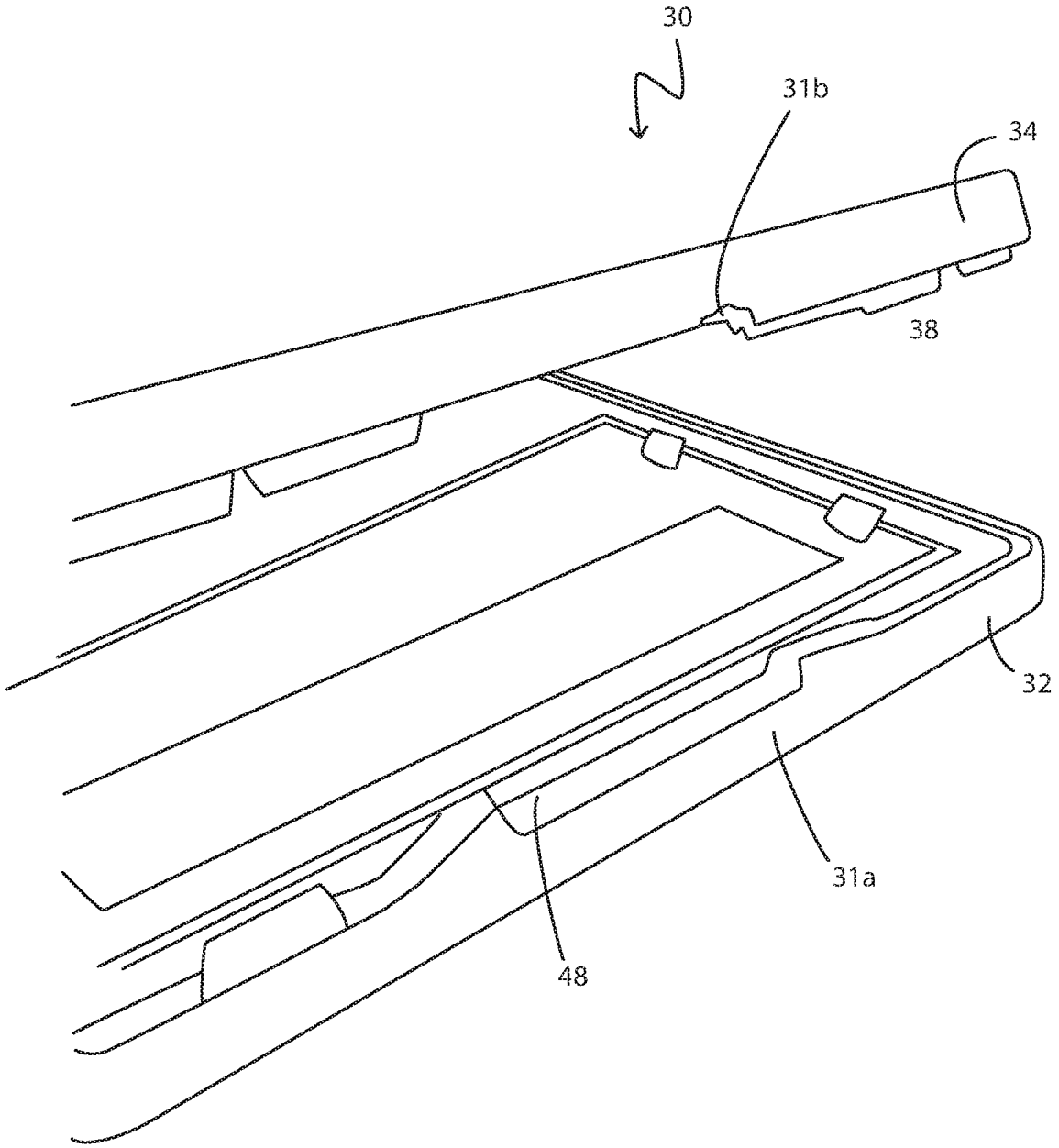
FIG. 4 illustrates a slot of a case in accordance with one embodiment.

The packaging system may further comprise a case for receiving the card unit. FIG. 2 illustrates an open case 30 in accordance with one embodiment. In the embodiment shown, the case 30 is a clamshell case. The clamshell case 30 may have a first section 32, a second section 34, and one or more hinges such as hinge 36. The hinge 36 joins the first section 32 and the second section 34 and allows the case 30 to open and close. It is to be appreciated that the first section 32 and the second section 34 is intended to refer to one side of the case and the other side of the case. The first section 32 and the second section 34 may not have the same sizing and may vary from one another in configuration. In other embodiments, other types of cases may be used, such as a box, a tin, etc. As shown in FIGS. 3 and 4, a slot 31 may be provided in a periphery of the case 30.

As shown in FIG. 2, an insert 38 may be positioned in the case 30. In the embodiment of FIG. 2, the insert is a plastic insert. The insert 38 includes a card receiving portion 40 and tabs 42 for holding the card in place in the card receiving portion 40. In the embodiment shown, the insert 38 may include a first section portion 44 for receipt by the first section of the case and a second section portion 46 for receipt by the second section of the case. In other embodiments, the insert 38 may include only a first section portion or a second section portion. As shown, an indent 48 may be provided in the insert 38 for receiving the stem of the card unit. The indent 48 may form a slot portion in the periphery of the insert 38 and may align with the slot 31 of the case 30. In some embodiments, an insert may not be used and the case may simply close around the stem of the card unit. In other embodiments, the insert may be configured to receive an additional item such as a promotional item.

FIG. 3 illustrates an alternative embodiment of a case 30 and insert 38. In the embodiment of FIG. 3, the insert 38 is a foam insert. As shown, the foam insert has a card receiving portion 40 for receiving the card of the card unit and an indent 48 for receiving the stem of the card unit. FIG. 3 illustrates the slot 31 provided in the periphery of the case 30 and aligning with a portion of the indent 48. The indent 48 and slot 31 align and together receive the stem of the card unit and allow the hanger to extend outwardly from the case.

FIG. 4 illustrates a slot of a case 30 in accordance with one embodiment. In the embodiment shown, the slot is formed from a first slot portion 31*a* formed in the first section 32 of the case and a second slot portion 31*b* formed in the second section 34 of the case. The slot is thus formed when the case 30 is closed. In some embodiments, only one slot portion may be used to form the slot. The insert 38 within the case may have an indent 48 cooperating with the slot to receive the stem of the card unit and allow the hanger of the card unit to extend outwardly from the case.

Figure 5:
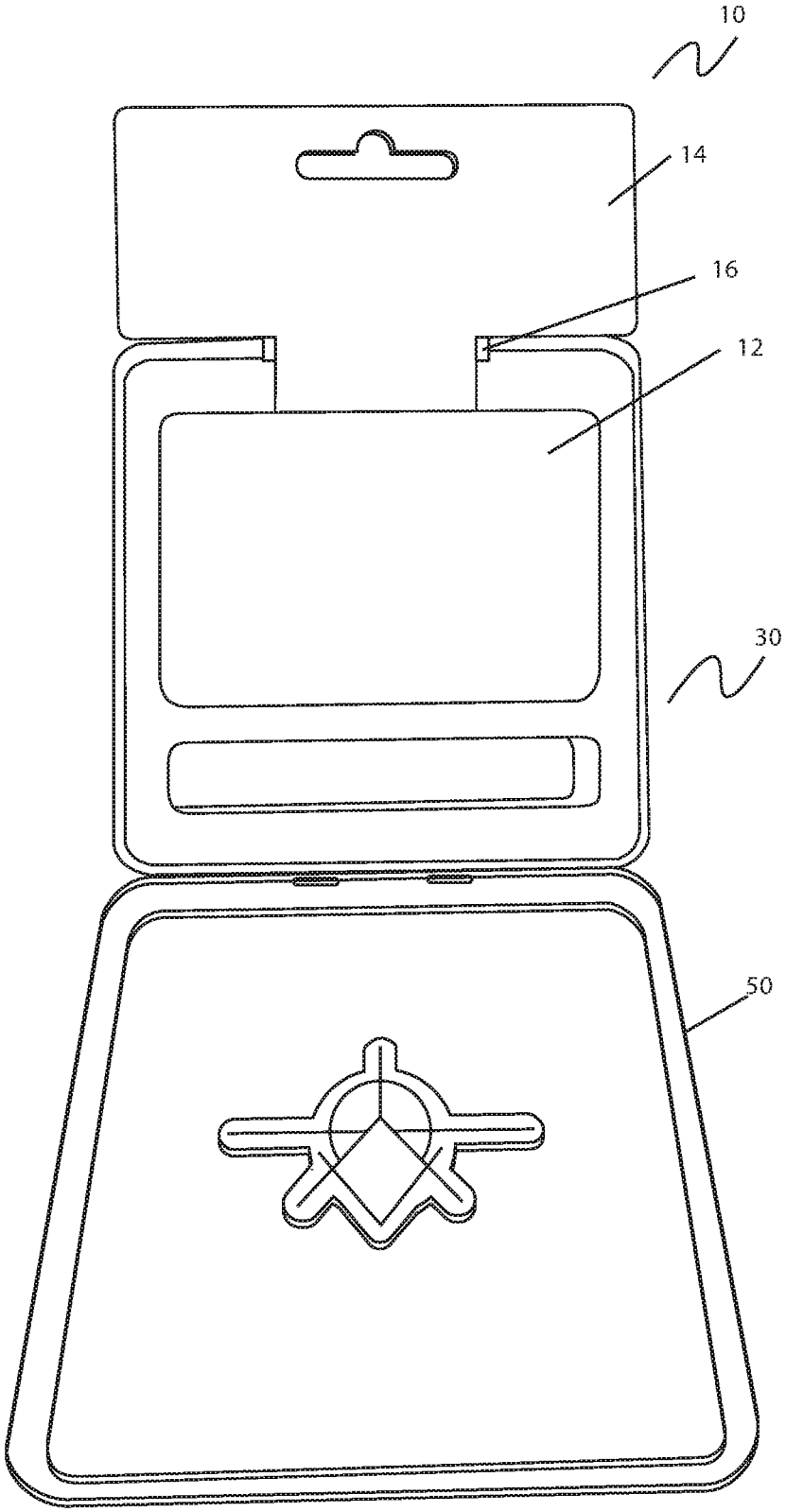
FIG. 5 illustrates an open case with a card unit in position in the case in accordance with one embodiment.
Figure 6:
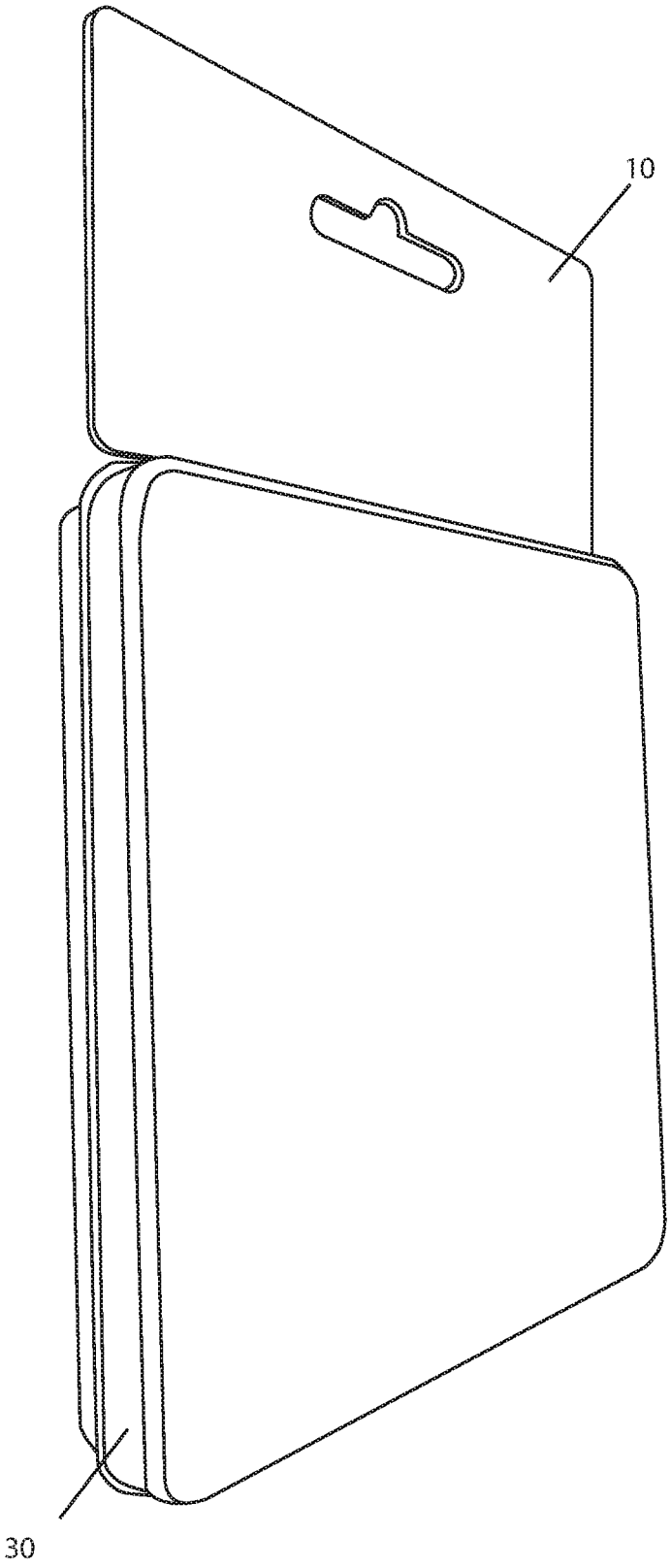
FIG. 6 illustrates a card packaging system in accordance with one embodiment.

FIG. 5 illustrates an open case 30 with a card unit 10 placed therein. An insert 38 is provided in a first section portion 44 of the case 30. As placed in the case 30, the card 12 of the card unit 10 is received in the card receiving portion 40 of the insert 38. The stem 16 of the card unit 10 is received by the indent 48 of the insert 38. The hanger 14 of the card unit 10 extends outwardly from the case 30. In some embodiments, no stem 16 may be provided and the hanger 14 may extend from the card 12 through the indent 48 and outwardly from the case 30. An item 50, such as a promotional item, may be placed in the case 30. In the embodiment shown, the item 50 is affixed to an insert in the second section 34 of the case. In other embodiments, the insert may include a receptor for receiving a promotional item. The receptor may be, for example, a hollow in the insert generally following the shape of the promotional item. In some embodiments, no insert may be provided in the second section 34 of the case 30. Further, in some embodiments, the item 50 may not be fixed in position in the case 30.

Information printed on the card 12 of the card unit 10 is not publicly viewable because of its position within the case 30. In contrast, information printed on the hanger 14 of the card unit 10 is publicly viewable. Accordingly, it may be useful to print serial number information on the hanger 14 of the card unit 10 and PIN information on the card 12 of the card unit 10. In some embodiments, the serial number information may be printed on both the hanger 14 and the card 12 so that the serial number information is available to a user after detaching the hanger 14 from the card 12.

FIG. 5 illustrates a packaging unit in accordance with one embodiment. As shown, the packaging unit includes a card unit 10 and a case 30. When a card unit 10 is placed in the case 30 and the case 30 is closed, the hanger 14 of the card unit 10 is visible outside of the case 30. The packaging unit is sleek and may be hung from existing merchandisers for cases selling items in cases, such as in clamshell cases.

The hanger 14 and stem 16 may be broken away from the card 12, either while the card 12 is within the case 30 or upon removal of the card 12 from the case. Upon removal of the hanger 14 and stem 16, or of the entire card unit 10, from the case 30, the case 30 has no visible remnants from the card unit or the hanger—for example, there is no glue or other adhesive from adhering a hanger from the case. The package is thus aesthetically pleasing for a gift or for collectability.

The inventive packaging system may take advantage of existing packaging. A slot may be provided in existing packaging, and an insert optionally placed in the existing packaging, for receiving a card unit such as shown and described with respect to FIGS. 1*a* and 1*b*. The card unit may be customized for existing packaging and/or merchandisers. For example, the size of the stem and the hanger may be customized for existing packaging and/or merchandisers. To work with the card unit, the existing packaging need only to accommodate receipt of the card within the packaging and extension of the hanger from the packaging, for example by providing a slot in the packaging.

With the serial number information 20 printed on the hanging component 14 of the card unit 10, visible outside of the case 30 of the packaging system, the card can be easily tracked throughout the entire process. In particular, retail store tracking is easier because the serial number is outside of the package and can be camera verified, making production and tracking quicker and more efficient. The packaging system facilitates knowledge of which card is inside each case and tracking and verification from outside of the case. In addition, at the point of sale, a window is no longer needed as the card that is inside of the case can be activated using the portion of the card unit that is outside of the case. Thus, the variable codes of the card can be tracked and are generally secure even with the card inside of the case and unable to be seen directly. Moreover, the inventive packaging system has the advantageous quality of evenly distributing the hanging weight of the package, thus orienting the package without tilting and perpendicular to the ground. This allows viewers to more easily see any images or wording printed on the package.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A card packaging system comprising:
a card unit, the card unit comprising:
a card, the card having a card width;
a hanger; and
a stem, the stem being positioned between the card and the hanger and having a stem width, wherein the stem width is less than half of the card width;
wherein the card may be separated from the hanger and the stem; and
a case for receiving the card unit, the case comprising:
a top edge, a bottom edge, and a periphery extending therearound, wherein the top edge has an edge length; and
a slot, wherein the slot has a slot length;
wherein the slot is provided along the top edge and the slot length is less than half of the edge length;
wherein, when the case is closed, the case is sealed along the periphery except at the slot and wherein, when the card is positioned in the case, the stem extends through the slot and the hanger extends outwardly from the case;
an insert having a card receiving portion for receiving the card and a receptor for receiving an item; and
an item positioned in the receptor.

2. The card packaging system of claim 1, wherein the card, the hanger, and the stem are integral and further comprising a divider between the card and the stem.

3. The card packaging system of claim 1, wherein the divider is a cut line.

4. The card packaging system of claim 1, wherein a serial number is printed on the hanger and a personal identification number is printed on the card.

5. The card packaging system of claim 1, wherein the hanger includes a hole for receiving an extension from a merchandising unit.

6. The card packaging system of claim 1, wherein the case is a clamshell case.

7. The card packaging system of claim 6, wherein the case comprises a first section and a second section and a hinge joining the first section and the second section, the hinge being provided along the bottom edge, wherein the slot is formed along the periphery between the first section and the second section when the case is closed.

8. The card packaging system of claim 1, wherein the insert is foam and includes a card receiving portion.

9. The card packaging system of claim 1, wherein the hanger has a hanger width and the hanger width is more than the card width.

10. The card packaging system of claim 9, wherein the hanger width is equal to the edge length.

11. The card packaging system of claim 1, wherein the slot length is less than a third of the edge length.

12. A card packaging system comprising:
a card unit, the card unit comprising:
a card, the card having a card width;
a hanger; and
a stem, the stem being positioned between the card and the hanger and having a stem width, wherein the stem width is less than half of the card width;
wherein the card may be separated from the hanger and the stem; and
a clamshell case for receiving the card unit, the case comprising:
a top edge, a bottom edge, and a periphery extending therearound, wherein the top edge has an edge length; and
a slot, wherein the slot has a slot length;
wherein the case comprises a first section and a second section and a hinge joining the first section and the second section, the hinge being provided along the bottom edge, wherein the slot is provided along a top edge along the periphery between the first section and the second section when the case is closed, wherein the slot length is less than half of the edge length;
wherein, when the case is closed, the case is sealed along the periphery except at the slot; and
wherein, when the card is positioned in the case, the stem extends through the slot and the hanger extends outwardly from the case; and
an insert, wherein the insert includes a first section portion for receipt by the first section of the case, and wherein the first section portion includes an indent for receiving the stem of the card unit, wherein the indent aligns with the slot when the insert is positioned in the case.

13. The card packaging system of claim 12, wherein the insert includes a second section portion for receipt by the second section of the case.

14. A card packaging system comprising:
a card unit, the card unit comprising:
a card; and a hanger; and a case for receiving the card unit, the case comprising:

a top edge, a bottom edge, and a periphery extending therearound, the top edge having an edge length; and a slot, the slot having a slot length;

wherein the slot is provided along the top edge and the slot length is less than half of the edge length;

wherein when the case is closed, the case is sealed along the periphery except at the slot; and wherein, when the card is positioned in the case, the hanger extends through the slot and the hanger extends outwardly from the case an insert having a card receiving portion and a receptor for receiving an item, wherein the card receiving portion is separate from the receptor for receiving an item.

15. The card packaging system of claim 14 wherein the card and hanger are integral and further comprising a divider between the card and the hanger.

16. The card packaging system of claim 14, wherein the hanger includes a hole for receiving an extension from a merchandising unit.

17. A card packaging system comprising:

a card unit, the card unit comprising:

a card, the card having a card width;

a hanger, the hanger including a hole for receiving an extension from a merchandising unit; and a stem, the stem being positioned between the card and the hanger, the stem having a stem width, wherein the stem width is less than half of the card width;

wherein the card may be separated from the hanger and the stem; and a case for receiving the card unit, the case comprising:

a first section and a second section;

a hinge at a bottom edge of the case, the hinge coupling the first section to the second section, wherein the first section and the second section fold along the hinge to close the case; and a slot;

wherein, when the case is closed, the slot is provided along a periphery of the case, wherein the case is sealed along the periphery except at the slot, and wherein the slot is configured to receive the stem such that when the card is positioned in the case, the hanger extends outwardly from the case; and an insert having a card receiving portion for receiving the card and a receptor for receiving an item, wherein the card receiving portion is separate from the receptor for receiving an item.

* * * * *